US005369865A

United States Patent [19]

Hirokawa et al.

[11] Patent Number: 5,369,865

[45] Date of Patent: Dec. 6, 1994

[54] METHOD AND APPARATUS FOR SUPPLYING SLIDERS TO SLIDE FASTENER STRINGERS

[75] Inventors: Yoichi Hirokawa; Tsutomu Hakoi, both of Kurobe, Japan

[73] Assignee: Yoshida Kogyo K.K., Tokyo, Japan

[21] Appl. No.: 156,735

[22] Filed: Nov. 24, 1993

[30] Foreign Application Priority Data

Nov. 26, 1992 [JP] Japan ..... 4-353447

[51] Int. Cl.[5] ..... A41H 37/06; B21D 53/50

[52] U.S. Cl. ..... 29/408; 29/768

[58] Field of Search ..... 29/408, 409, 768, 33.2

[56] References Cited

U.S. PATENT DOCUMENTS

| | | | |
|---|---|---|---|
| 2,800,157 | 7/1957 | Muika . | |
| 3,530,563 | 9/1970 | Maeda . | |
| 3,626,579 | 12/1970 | Maeda | 29/408 |
| 3,629,926 | 12/1971 | Maeda . | |
| 5,142,773 | 9/1992 | Yunoki | 29/768 |

FOREIGN PATENT DOCUMENTS

| | | |
|---|---|---|
| 63-31810 | 3/1963 | Japan . |
| 45-16624 | 6/1970 | Japan . |
| 731144 | 6/1955 | United Kingdom . |

*Primary Examiner*—P. W. Echols

*Attorney, Agent, or Firm*—Hill, Steadman & Simpson

[57] ABSTRACT

A method and apparatus for supplying a slider to a slide fastener stringer in motion along a path of travel for the purpose of attaching the slider to the slide fastener stringer are disclosed. The apparatus comprises in combination a slider chute for delivering one slider after another in an upright posture, means for rotatably and releasably supporting the delivered slider at the lower end of the slider chute, means for rotating the slider so as to shift its upright posture to a horizontal posture, and a gripper for nipping the slider on opposite lateral surfaces thereof. The gripper is adapted to reciprocate in a vertical direction between the lower end of the slider chute and an assembly position in a path of travel of the slide fastener stringer positioned as separated downwardly from the slider chute.

19 Claims, 6 Drawing Sheets

METHOD AND APPARATUS FOR SUPPLYING SLIDERS TO SLIDE FASTENER STRINGERS

BACKGROUND OF THE INVENTION

1. Field of the Invention

This invention relates to a method and apparatus for supplying a slider to a slide fastener stringer in motion along a path of travel for the purpose of attaching the slider to the slide fastener stringer. More particularly, this invention relates to a method and apparatus for the supply of sliders which can be utilized advantageously for supplying sliders particularly for waterproof slide fasteners, invisible slide fasteners, etc.

2. Description of the Prior Art

It has been known that an apparatus for supplying sliders to a slide fastener stringer maintained in a successive movement along a horizontal path of travel is available for effecting automatic attachment of sliders to a slide fastener stringer. One known arrangement heretofore adopted for the supply of ordinary sliders is composed of a vertical chute and a swinging arm disposed in an obliquely downward position relative to the vertical chute and is adapted to rotate the arm so as to move a slider holding part provided at the leading end thereof along an arcuate locus defined between the lower end of the vertical chute and a predetermined point in the path of travel of the slide fastener stringer at which the assembly takes place and consequently effect supply of sliders to a slider supporting means kept waiting in the path of travel mentioned above, as disclosed in U.S. Pat. No. 3,530,563 issued Sep. 29, 1970 to M. Maeda, U.S. Pat. No. 3,626,579 issued Dec. 14, 1971 to M. Maeda, U.S. Pat. No. 3,629,926 issued Dec. 28, 1971 to M. Maeda, and corresponding Japanese Patent Publication No. SHO 45-16624. Another known arrangement is composed of a vertical chute and a horizontal chute disposed in the proximity of the lower end of the vertical chute and is adapted to cause sliders discharged in an upright posture from the vertical chute through the lower end opening thereof to be laid in a horizontal posture on the horizontal chute, supply the sliders in the horizontal posture with a moving rod to a slider holding device kept waiting at the leading end of the horizontal chute, and lower the slider holding device now holding the sliders to the path of travel of the slide fastener stringer and set it waiting at a predetermined position where the assembly takes place, as disclosed in published Japanese Utility Model Application, KOKAI (Early Publication) No. SHO 63-31810.

The conventional arrangements for the supply of sliders mentioned above, in the process of supplying sliders to the slide fastener stringer in motion along the path of travel, require the sliders discharged through vertical chute to shift their postures from the upright to the horizontal direction by the use of the swinging arm or the horizontal chute preparatory to the supply of sliders. They are, therefore, at a disadvantage in necessitating a wide floor space for the posture shifting device and entailing an extra time for the supply.

For the invisible slide fasteners and the waterproof slide fasteners, no arrangement useful for the supply of sliders has yet been proposed because these slide fasteners, unlike the ordinary slide fasteners, require the slide fastener stringers thereof to be passed through the passageways or slide grooves formed on the upper or lower side of the sliders and, as a result, the work of fitting the sliders to the slide fastener stringers cannot be easily automated.

SUMMARY OF THE INVENTION

It is, therefore, an object of the present invention to provide a method and apparatus for permitting, in the assembly of slide fasteners, quick and efficient supply of sliders to slide fastener stringers in motion along a path of travel without requiring a wide space for any posture shifting device.

A more specific object of the present invention is to provide a method and apparatus for attaching a slider to a slide fastener stringer of the sliding clasp fastener type for use in the invisible slide fasteners and the waterproof slide fasteners.

Another object of the present invention is to provide an apparatus which combines a slider supply chute with a slider posture shifting device and consequently, in the process of supply of a slider to a slide fastener stringer in motion along the path of travel thereof, allows the shift of posture of the slider to be effected efficiently.

To accomplish the objects described above, in accordance with the first aspect of the present invention, there is provided a method for supplying a slider to a slide fastener stringer. The method comprises the steps of delivering one slider after another in an upright posture downwardly through a slider chute, receiving and rotatably supporting the delivered slider at the lower end of the slider chute, then rotating the slider in situ to shift its upright posture to the horizontal posture, gripping said slider by a gripper adapted to reciprocate in a vertical direction between the lower end of said slider chute and an assembly position in a path of travel of said slide fastener stringer positioned as separated downwardly from said slider chute and moving said slider to said position.

In accordance with the second aspect of the present invention, there is provided an apparatus for supplying a slider to a slide fastener stringer. The apparatus comprises in combination a slider chute for delivering one slider after another in an upright posture, a slider posture shifting device disposed near the lower end of the slider chute and provided with slider receiving means for rotatably and releasably supporting the delivered slider and posture shifting means for rotating the slider so as to shift its upright posture to a horizontal posture, and a gripper for nipping the slider on opposite lateral surfaces thereof. The gripper is adapted to reciprocate in a vertical direction between the lower end of the slider chute and an assembly position in a path of travel of the slide fastener stringer positioned as separated downwardly from the slider chute.

BRIEF DESCRIPTION OF THE DRAWINGS

The other objects, features, and advantages of the present invention will become more apparent from the following detailed description taken in connection with the accompanying drawings in which.

DETAILED DESCRIPTION OF THE PREFERRED EMBODIMENTS

Figure 1:
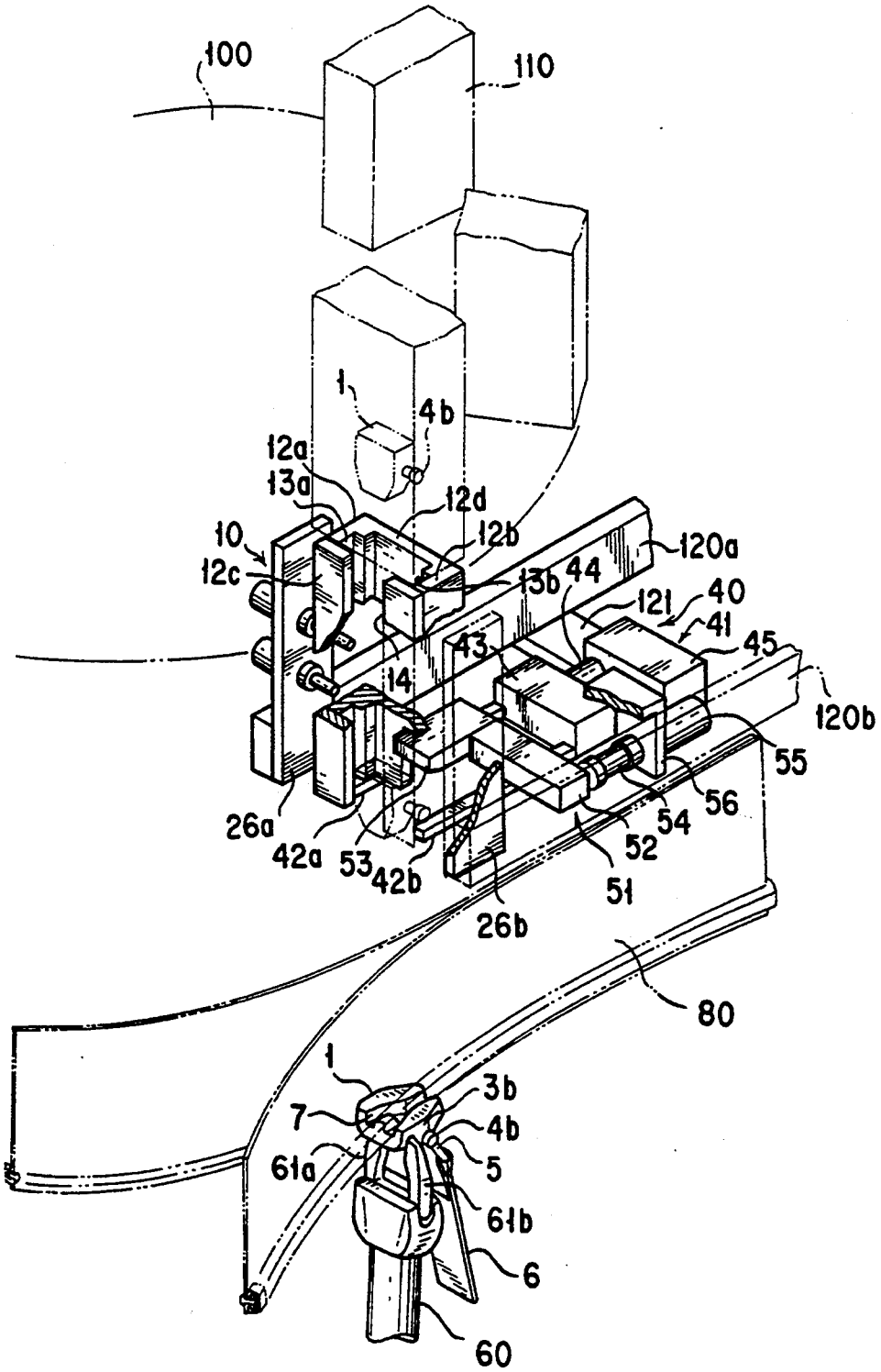
FIG. 1 is a perspective view, partially exploded, illustrating the essential parts of one embodiment of the apparatus for supply of sliders according to the present invention.

FIG. 1 depicts a typical application of the apparatus according to the present invention to the supply of sliders for a waterproof slide fastener. The apparatus for the supply of sliders is composed of a vertical slider chute 10 for supplying sliders, a slider posture shifting device 40, and a gripper 50, which are sequentially arranged in a row in the descending order as shown in FIG. 1.

Sliders 1 are sequentially supplied from a slider cassette 110 provided on a turn table 100 intermittently rotated as shown by a chain line in FIG. 1 into a slider chute 10 through the upper end opening thereof. Since the slider supplying system which is constructed as described above is an ordinary one, the details thereof will be omitted from the following description and pictorial illustration.

Figure 2:
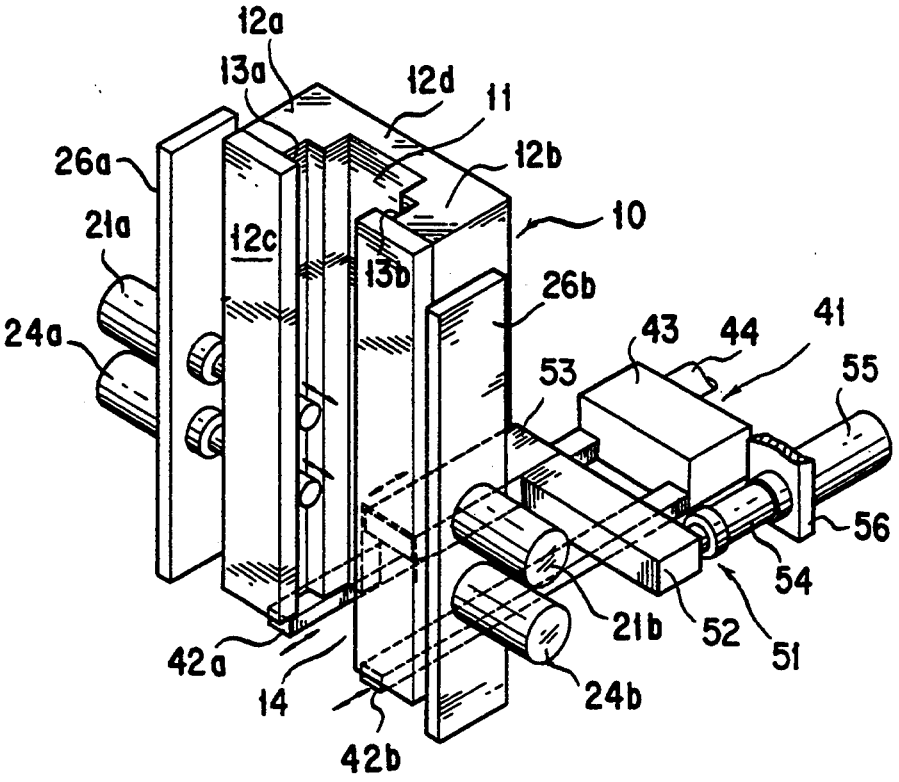
FIG. 2 is a perspective view illustrating the arrangement of a vertical slider chute and a slider posture shifting device shown in FIG. 1, which forms one important aspect of the invention.

As clearly shown in FIG. 2, the slider chute 10 has a passageway 11 for a delivery of sliders extending in a vertical direction from the upper to the lower end thereof. The passageway 11 has slightly larger cross-sectional dimensions than those of a slider 1. In the inside surfaces of opposite lateral walls 12*a* and 12*b* of the slider chute 10, a pair of grooves 13*a* and 13*b* are formed throughout the height from the upper to the lower end. These grooves 13*a* and 13*b* serve respectively as guides for a pair of pins 4*a* and 4*b* projected from opposite lateral surfaces 3*a* and 3*b* of the slider 1 for a waterproof slide fastener and adapted to permit attachment of a pull tab 6. The slider 1 is accommodated in the passageway 11 of the slider chute 10 mentioned above, with the pins 4*a* and 4*b* on the opposite sides thereof respectively inserted in the grooves 13*a* and 13*b*. In a front wall 12*c* of the slider chute 10, an opening 14 extending in the vertical direction is formed throughout the height from the upper to the lower end thereof. A notch 15 is formed in the lower end part of a rear wall 12*d* of the slider chute 10 (see FIG. 4A). The pull tab 6 of the slider 1 is destined to assume a position in the opening 14 when the slider 1 is accommodated in the slider chute 10. The notch 15 is so adapted that the upper end thereof will fall flush with or rise above an upper part 2*a* of the slider 1 supported in an upright posture by supporting rods 42*a* and 42*b* which will be specifically described afterward. A pair of fixed frames 120*a* and 120*b* are disposed on the opposite sides of the slider chute 10. The slider chute 10 is fixedly secured to the fixed frames 120*a* and 120*b* with suitable fixing means (not shown).

On the opposite lateral parts of the slider chute 10, a pair of stopper fixing plates 26*a* and 26*b* are parallelly disposed in the vertical direction as separated by a prescribed gap from the lateral surfaces of the chute, with the lower end parts of the plates 26*a* and 26*b* fixed respectively to the fixed frames 120*a* and 120*b*. To the plates 26*a* and 26*b*, a pair of first stoppers 20*a* and 20*b* and a pair of second stoppers 23*a* and 23*b* are attached as vertically separated by a distance substantially equal to the length of a slider as clearly illustrated in FIG. 4A so as to allow downward delivery of one after another of the sliders 1 accommodated in the supply passageway 11. The first stoppers 20*a* and 20*b* are respectively composed of pressure cylinders 21*a*, 21*b* and pistons 22*a*, 22*b*. Likewise, the second stoppers 23*a* and 23*b* are composed respectively of pressure cylinders 24*a*, 24*b* and pistons 25*a*, 25*b*. The first stoppers 20*a*, 20*b* and the second stoppers 23*a*, 23*b* are caused by mutual reciprocation of their own pistons 22*a* , 22*b* and 25*a*, 25*b* to have the leading ends thereof plunge laterally into and out of the grooves 13*a* and 13*b* formed in the inner surfaces of the lateral walls 12*a* and 12*b* of the slider chute 10 and come into engagement with the pins 4*a* and 4*b* on the opposite sides of the slider 1 and prevent the slider 1 from falling down. The operation of the engagement of the pistons of the stoppers with the slider will be described specifically afterward.

The slider posture shifting device 40 is disposed in the proximity of the lower part of the vertical chute 10 and is composed of slider receiving means 41 and posture shifting means 51.

Figure 4A:
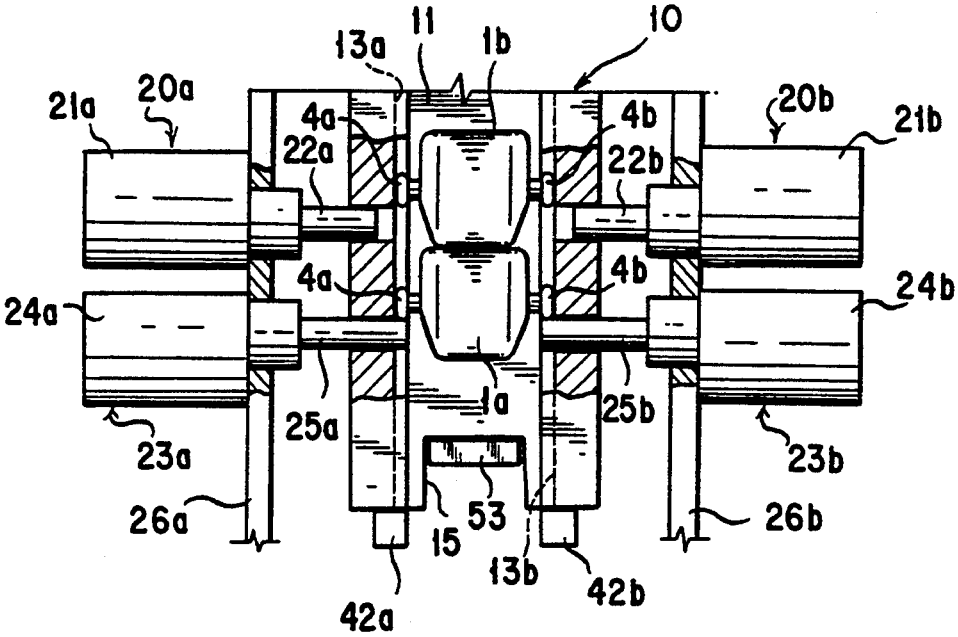
FIG. 4A is a partially sectioned front view of the lower part of the slider chute in the apparatus shown in FIG. 1, illustrating the state in which sliders are supplied one by one through the chute.
Figure 4B:
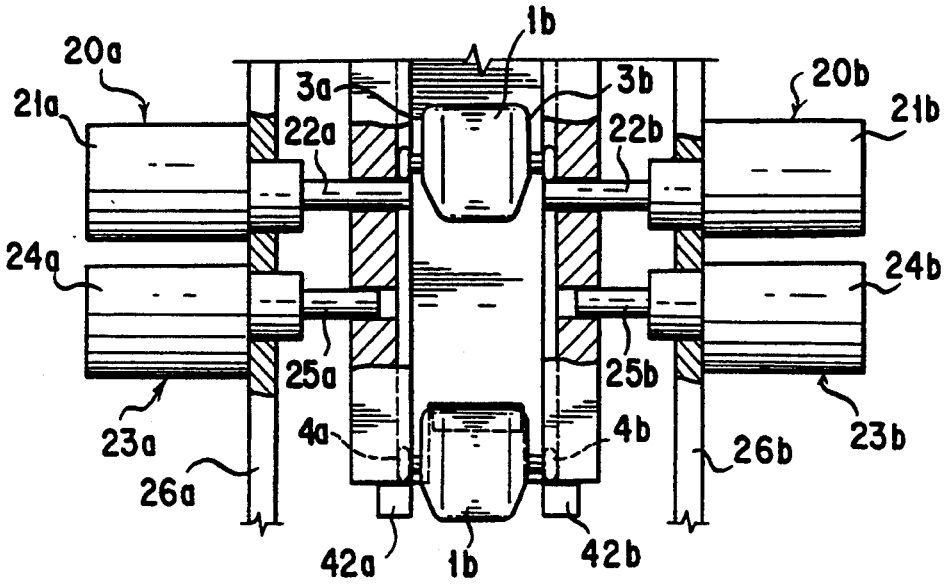
FIG. 4B is a partially sectioned front view of the lower part of the chutes, illustrating the state in which the lowermost of the sliders accommodated in the chute has descended.

A slider receiving means 41, as illustrated in FIGS. 1, 2 and 4A comprises a pair of parallel supporting rods 42*a* and 42*b* disposed contiguously to the lower ends of the grooves 13*a* and 13*b* of the slider chute 10, a fixing plate 43 having one end each of the supporting rods 42*a* and 42*b* fixed thereto, and a pressure cylinder 45 having a piston 44 connected to the fixing plate 43. The pressure cylinder 45 is fixed to a cross bar 121 fixedly secured to the frames 120*a* and 120*b*. By the operation of the pressure cylinder 45, the pair of supporting rods 42*a* and 42*b* are reciprocated in the longitudinal direction between the slider supporting position shown in FIG. 5A and the release position shown in FIG. 5C. While the supporting rods 42*a* and 42*b* are kept at the advanced position, the slider 1 which has been descending under its own weight inside the passageway 11 of the slider chute 10 is stopped by the collision of the pins 4*a* and 4*b* on the opposite sides thereof against the supporting rods 42*a* and 42*b* as illustrated in FIGS. 4B and 5A and rotatably supported by the supporting rods 42*a* and 42*b*, with the pins 4*a* and 4*b* inserted in the grooves 13*a* and 13*b* of the slider chute 10.

Figure 5A:
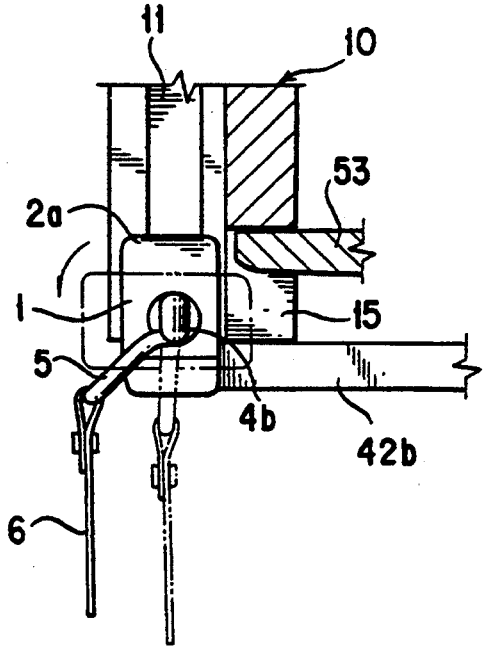
FIG. 5A is a partially sectioned side view of the lower end part of the chute in the apparatus shown in FIG. 1, illustrating the state in which slider fallen through the chute is set on and supported by supporting rods.
Figure 5B:
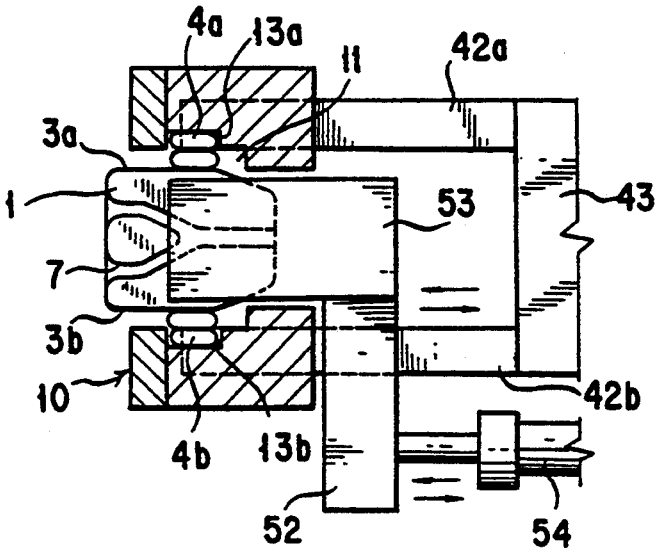
FIG. 5B is a partially sectioned plan view illustrating the state in which the slider supported on the supporting rods is laid forwardly by a push bar.

Posture shifting means 51, as illustrated in FIGS. 2, 5A and 5B, comprises a push bar 52 of the general shape of the letter "L" provided with a pushing part 53 disposed under the upper end of the notch 15 formed at the lower end of the rear wall 12*d* of the slider chute 10 and a pressure cylinder 55 having a piston 54 connected to the push bar 52. The pressure cylinder 55 is fixed to the frame 120*b* with a member 56. The pushing part 53 is so positioned that the height thereof will approximately equal to the height of the upper part 2a of a main body 2 of the slider 1 supported in the upright posture by tile supporting rods 42a and 42b. By the operation of the pressure cylinder 55, the push bar 52 and the pushing part 53 at the leading end thereof are reciprocated in the longitudinal direction.

The gripper 60, as illustrated in FIG. 1, has a pair of clamping claws 61a and 61b at the upper part thereof and is adapted so that the gripper 60 will nip the slider 1 by causing the leading ends of the clamping claws 61a and 61b to be closed against the opposite lateral surfaces 3a and 3b of the slider 1. The gripper 60 is disposed as separated downwardly from the slider chute 10 and is adapted to reciprocate in the vertical direction so as to cause the slider 1 which has undergone a shift of posture in the lower end part of the slider chute 10 to be supplied to a position in the path of travel of the slide fastener stringer 80 where the assembly takes place (assembly position). The path of travel of the slide fastener stringer is positioned below the slider posture shifting device 40.

Figure 3:
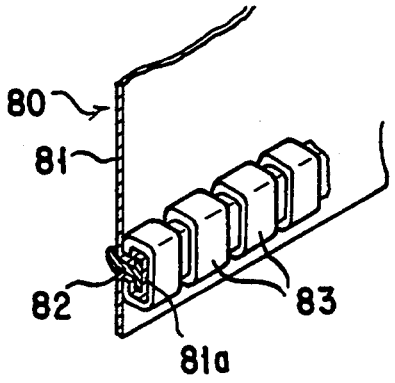
FIG. 3 is a partially sectioned perspective view of a waterproof slide fastener stringer shown in FIG. 1.

The slide fastener stringer 80, as illustrated in FIG. 3, is of the type of sliding clasp fastener assembled by embedding studs 82 as spaced in the longitudinal direction in a folded part 81a at the edge of a fastener strip 81 and gripping the same therein by clamp elements 83 clamped externally about the folded part 81a. This type of sliding clasp fastener is well known in the art as disclosed, for example, in U.S. Pat. No. 2,800,157 issued Jul. 23, 1957 to F. Mulka and British Patent No. 731,144, the teachings of which are hereby incorporated by reference. The details of this sliding clasp fastener, therefore, will be omitted from the description to be given hereinafter. The slider 1 which is attached to the slide fastener stringer 80 is composed of the main body 2, the pair of pins 4a and 4b formed projectingly on the opposite lateral surfaces 3a and 3b of the main body 2, an arm 5 having the opposite end parts thereof rotatably attached to the pins 4a, 4b, and the pull tab 6 rotatably attached to the arm 5. The main body 2 has on the lower surface thereof a passageway or slide groove 7 which permits insertion therethrough of the edges of the fastener stringers 80 mentioned above having the clamp elements 83 attached thereto.

Now, the operation of the apparatus according to the present invention will be described. The slider 1 accommodated in the slider chute 10 is of course provided with the pull tab 6. In order that the arrangement and the operation of the apparatus according to the present invention may be more readily understood, the pull tab of the slider is not illustrated in FIGS. 4A and 4B.

With reference to FIG. 4A, when the pair of first stoppers 20a, 20b and the pair of second stoppers 23a, 23b are operated, the corresponding pistons 22a, 22b and 25a, 25b are reciprocated with predetermined intervals of time. When the pistons 22a and 22b of the first stoppers 20a and 20b are at their retracted positions and the pistons 25a and 25b of the second stoppers 23a and 23b are at the advanced positions such that the leading ends of the pistons 25a and 25b are protruded into the grooves 13a and 13b of the slider chute 10 as illustrated in FIG. 4A, the lowermost slider 1a is prevented from falling by the fact that the opposite pins 4a and 4b thereof are supported by the leading end parts of the pistons 25a and 25b of the second stoppers 23a and 23b. Then, the pistons 22a and 22b of the first stoppers 20a and 20b are advanced to the point of supporting the pins 4a and 4b of the immediately next slider 1b and consequently keeping the slider 1b from falling. When the pistons 25a and 25b of the second stoppers 23a and 23b in the ensuant states are retracted, the lowermost slider 1a is allowed to fall. The slider 1a which has fallen off the slider chute 10, as shown in FIG. 4B, allows the opposite pins 4a and 4b thereof to collide against the supporting rods 42a and 42b protruding to the lower end of the slider chute 10 and remain fast thereon. The slider 1a supported on the supporting rods 42a and 42b, by the operation to be described hereinafter, is nipped by the gripper 60 and forwarded to the slide fastener stringer. Subsequently, when the pistons 25a and 25b of the second stoppers 23a and 23b are advanced again and the pistons 22a and 22b of the first stoppers 20a and 20b are retracted, the sliders accommodated in the slider chute 10 are allowed to fall. However, the next lowermost slider 1a in slider chute 10 is prevented from falling by the fact that the opposite pins 4a and 4b thereof are supported, as illustrated in FIG. 4A, by the leading end parts of the pistons 25a and 25b of the second stoppers 23a and 23b. In the manner described above, the sliders 1 are forwarded one after another to the lower end part of the slider chute 10.

Now, the operation of shifting the posture of the slider 1 supported by the supporting rods 42a, 42b will be described below with reference to FIGS. 5A and 5B. When the leading end of the pushing part 53 of the push bar 52 which is flush with the upper part 2a of the main body 2 of the slider 1 supported in the upright posture on the supporting rods 42a and 42b is caused by the operation of the pressure cylinder 55 to thrust into the passageway 11 of the slider chute 10 and push the upper part 2a of the slider 1, the slider 1 is laid from the upright posture to the horizontal posture as indicated by the chain line in FIG. 5A and the slider 1 is caused to assume a shifted posture for attachment to the slide fastener stringer 80. At this time, since the pins 4a and 4b of the slider 1 are accommodated in the grooves 13a and 13b of the lateral walls 12a and 12b of the slider chute 10 as illustrated in FIG. 5B, the slider 1 is rotated forwardly at the position at which the slider 1 is supported by the supporting rods 42a and 42b until it is allowed to assume an attachment posture such that the lower surface of the slider 1 having the slide groove 7 is turned upwardly as shown in FIG. 5B.

Figure 5C:
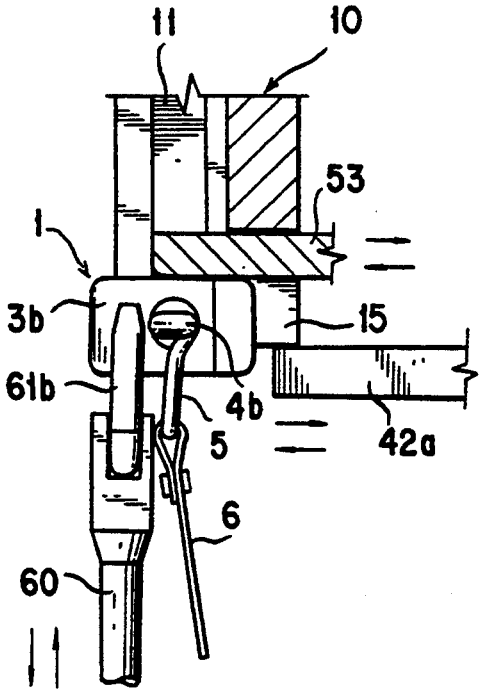
FIG. 5C is a partially sectioned side view illustrating the state in which the slider in the shifted posture is nipped by a gripper.

The slider 1 which has assumed the attachment posture in the horizontal direction in consequence of a shift of posture as described above is then nipped on the opposite lateral surfaces 3a and 3b thereof by the clamping claws 61a and 61b of the gripper 60 which has ascended meanwhile from below. Then the pair of supporting rods 42a and 42b are retracted and caused to cease supporting the slider 1 by the operation of the pressure cylinder 45, as shown in FIG. 5C. Then, the gripper 60 which has nipped the slider 1 descends to the assembly position in the path of travel of the slide fastener stringer at which the attachment of the slider to the slide fastener stringer is effected. When the slider 1 is forwarded to the assembly position by the gripper 60, the supporting rods 42a, 42b and the pushing part 53 of the push bar 52 return to the waiting positions shown in FIG. 5A and wait for the next slider to fall off the slider chute 10 and reach them.

Figure 6:
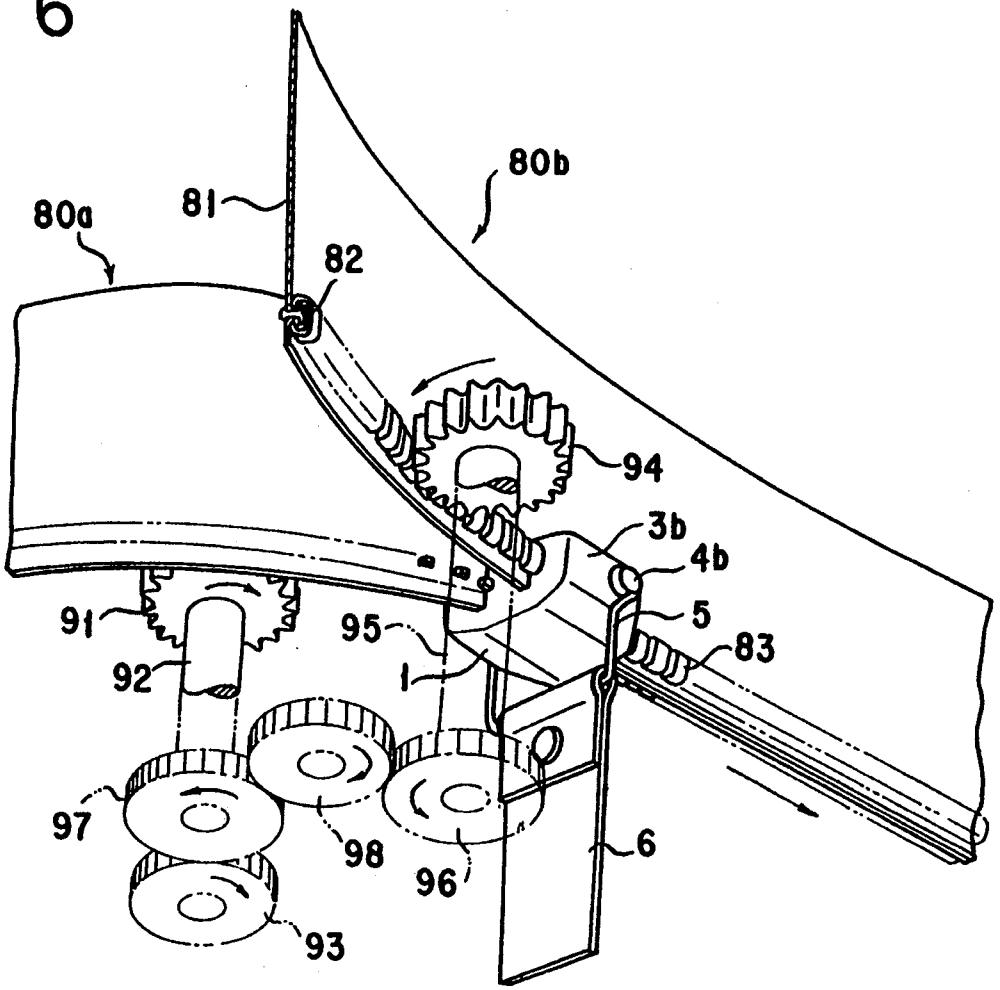
FIG. 6 is a perspective view illustrating the state in which the slider has been supplied to and attached to a waterproof slide fastener stringers in motion along a path of travel thereof.

FIG. 6 illustrates the state in which the edges of the pair of waterproof slide fastener stringers 80a and 80b of a prescribed length advanced by a pair of feed rolls 91 and 94 are threaded through the slide groove 7 of the slider 1 transferred by the gripper 60 to the slider assembly position in the path of travel of the slide fastener stringer and set thereat in a waiting posture. A gear 93 fixed at the lower end part of a rotating shaft 92 of the feed roll 91 is engaged with a gear 96 fixed at the lower end part of a shaft 95 of the feed roll 94 through the medium of gears 97 and 98. When the feed roll 91 is rotated clockwise, the other feed roll 94 is automatically rotated counterclockwise. The two slide fastener stringers 80*a* and 80*b*. therefore, are advanced in a matched state by the pair of feed rolls 91 and 94 each of the shape of a toothed wheel which are engaged with the clamp elements 83 of the fastener elements attached to the lower edges thereof. When the attachment of the slider 1 to the slide fastener stringers 80*a* and 80*b* is completed by causing the leading ends of the two slide fastener stringers 80*a* and 80*b* advanced as described above to be inserted into the slide groove 7 of the slider 1 nipped by the gripper 60, the clamping claws 61*a* and 61*b* of the gripper 60 are opened to release the slider 1 and then the gripper 60 is allowed to descend to the extent of facilitating passage of the slide fastener stringers 80*a* and 80*b*. After completion of this passage of the slide fastener stringers 80*a* and 80*b*, the gripper 60 ascends for the assembly of the next slider 1 and nips the slider 1 which has undergone a shift of posture. By the repetition of the operating cycle described above, the sliders 1 are attached one by one to the slide fastener stringers 80 of the prescribed length successively advanced.

The various phases of the operating cycle shared by the important components of the apparatus generally shown in FIG. 1 are interrelated and synchronized as described hereinbefore. However, it is not the intention of the present inventors to disclose any details of the power system which drives the operating components of the apparatus, or the electrical/mechanical units which control the timing of the operating components in the cycle. They are conventional and hence not illustrated.

As described in detail above, the present invention enables one slider after another delivered intermittently through a vertical slider chute to be received at the lower end of the slider chute as rotatably supported by the opposite lateral surfaces thereof and then to be rotated at the supported position and given a shifted attachment posture in the horizontal direction. The shift to the attachment posture of the slider can be effected without requiring a wide space and the supply of the slider to the assembly position can be attained quickly. Thus, the present invention contributes to enhance the efficiency of the final assembly process of slide fasteners and to realize automation of the work of attaching sliders to waterproof slide fasteners or invisible slide fasteners which has been heretofore carried out manually.

The invention may be embodied in other specific forms without departing from the spirit or essential characteristics thereof. The described embodiments are therefore to be considered in all respects as illustrative and not restrictive, the scope of the invention being indicated by the appended claims and all changes which come within the meaning and range of equivalency of the claims are, therefore, intended to be embraced therein.

What is claimed is:

1. A method for supplying a slider to a slide fastener stringer comprising the steps of:

delivering one slider after another in an upright posture downwardly through a slider chute;

receiving the delivered slider at the lower end of said slider chute while rotatably supporting said slider by opposite lateral surfaces thereof;

pushing the upper part of said slider to rotate the slider forwardly in situ and shift its upright posture to a horizontal posture; and gripping said slider by a gripper adapted to reciprocate in a vertical direction between the lower end of said slider chute and an assembly position in a path of travel of said slide fastener stringer positioned as separated downwardly from said slider chute and moving said slider to said position.

2. A method according to claim 1, wherein said slider comprises a main body having a slide groove on a surface thereof, a pair of pins projected from opposite lateral surfaces of said main body, and a pull tab rotatably attached to said pins and said pins are used as parts to be supported.

3. A method according to claim 1, wherein said slide fastener stringer is a sliding clasp fastener stringer of the type assembled by embedding studs as spaced in a longitudinal direction in a folded part at an edge of a fastener strip and gripping the same therein by clamp elements clamped externally about said folded part.

4. A method according to claim 2, wherein said slider is rotated so that the surface thereof having said slide groove is turned upwardly.

5. A method of attaching a slider having a slide groove on a surface thereof to a pair of slide fastener stringers of the type assembled by embedding studs as spaced in a longitudinal direction in a folded part at an edge of a fastener strip and gripping the same therein by clamp elements clamped externally about said folded part, said method comprising the steps of:

delivering the slider in an upright posture downwardly through a slider chute;

rotatably supporting said slider at the lower end of said slider chute;

rotating said slider in situ to shift its upright posture to a horizontal posture so that the surface thereof having said slide groove is turned upwardly;

gripping said slider and moving the same from the lower end of said slider chute to an assembly position in a path of travel of said slide fastener stringers positioned as separated downwardly from said slider chute;

advancing and threading the pair of slide fastener stringers through the slide groove of said slider; and repeating said steps.

6. A method of attaching a slider having a slide groove on a surface thereof and a pair of laterally projected pins to a pair of slide fastener stringers of the type assembled by embedding studs as spaced in a longitudinal direction in a folded part at an edge of an fastener strip and gripping the same therein by clamp elements clamped externally about said folded part, said method comprising the steps of:

delivering the slider in an upright posture downwardly through a slider chute;

rotatably supporting said slider at the lower end of said slider chute by using said lateral pins thereof as parts to be supported;

rotating said slider in situ to shift its upright posture to a horizontal posture so that the surface thereof having said slide groove is turned upwardly;

gripping said slider by a gripper adapted to reciprocate in a vertical direction between the lower end of said slider chute and an assembly position in a path of travel of said slide fastener stringers positioned as separated downwardly from said slider chute and moving said slider to said position;

advancing and threading the pair of slide fastener stringers through the slide groove of said slider; and repeating said steps.

7. An apparatus for supplying a slider to a slide fastener stringer comprising in combination:

a slider chute for delivering one slider after another in an upright posture;

a slider posture shifting device disposed near the lower end of said slider chute and provided with slider receiving means for rotatably and releasably supporting the delivered slider by opposite lateral surfaces thereof and posture shifting means for pushing the upper part of said slider thereby rotating said slider forwardly so as to shift its upright posture to a horizontal posture; and a gripper for nipping said slider on opposite lateral surfaces thereof, the gripper being adapted to reciprocate in a vertical direction between the lower end of said slider chute and an assembly position in a path of travel of said slide fastener stringer positioned as separated downwardly from said slider chute.

8. An apparatus according to claim 7, wherein said slider chute is provided with a slider passageway extending in the vertical direction from the upper end to the lower end of said slider chute and having a cross-sectional dimension accommodated to that of said slider.

9. An apparatus according to claim 7, wherein said slider chute is provided in a front wall thereof with an opening extending in the vertical direction from the upper to the lower end thereof and in tile lower end part of a rear wall thereof with a notch.

10. An apparatus according to claim 8, wherein said slider chute is provided on opposite lateral parts thereof with a pair of first stoppers and a pair of second stoppers disposed as vertically separated with an interval substantially equal to the length of said slider, each stopper having a piston capable of laterally thrusting into said slider passageway.

11. An apparatus according to claim 7, wherein said slider receiving means comprises a pair of parallel supporting rods disposed near the lower end of said slider chute and a pressure cylinder having a piston connected to said supporting rods.

12. An apparatus according to claim 9, wherein said slider posture shifting means comprises a push bar having a pushing part disposed under the upper end of said notch of the slider chute and a pressure cylinder having a piston connected to said push bar.

13. An apparatus according to claim 7, wherein said gripper has a pair of clamping claws capable of releasably nipping the slider at the upper part thereof.

14. An apparatus for supplying a slider having a slide groove on a surface thereof and a pair of laterally projected pins to a slide fastener stringer, comprising in combination:

a slider chute for delivering one slider after another in an upright posture, the chute being provided with a slider passageway extending in a vertical direction from the upper end to the lower end of said slider chute and a pair of grooves for guiding said lateral pins of the slider formed on opposite lateral surfaces of said passageway;

slider receiving means disposed near the lower end of said slider chute and adapted to rotatably and releasably support the delivered slider by opposite lateral pins thereof;

slider posture shifting means for pushing the upper part of said slider thereby rotating said slider forwardly so as to shift its upright posture to a horizontal posture; and a gripper for nipping said slider on opposite lateral surfaces thereof, the gripper being adapted to reciprocate in the vertical direction between the lower end of said slider chute and an assembly position in a path of travel of said slide fastener stringer disposed as separated downwardly from said slider chute.

15. An apparatus according to claim 14, wherein said slider chute is provided in a front wall thereof with an opening extending in the vertical direction from the upper to the lower end thereof and in the lower end part of a rear wall thereof with a notch.

16. An apparatus according to claim 14, wherein said slider chute is provided on opposite lateral parts thereof with a pair of first stoppers and a pair of second stoppers disposed as vertically separated with an interval substantially equal to the length of said slider, each stopper having a piston capable of laterally thrusting into said slider passageway.

17. An apparatus according to claim 14, wherein said slider receiving means comprises a pair of parallel supporting rods disposed near the lower ends of the grooves of said slider chute and a pressure cylinder having a piston connected to said supporting rods.

18. An apparatus according to claim 15, wherein said slider posture shifting means comprises a push bar having a pushing part disposed under the upper end of said notch of the slider chute and a pressure cylinder having a piston connected to said push bar.

19. An apparatus according to claim 14, wherein said gripper has a pair of clamping claws capable of releasably nipping the slider at the upper part thereof.

* * * * *